US010780722B2

(12) United States Patent
Inoue

(10) Patent No.: US 10,780,722 B2
(45) Date of Patent: Sep. 22, 2020

(54) MEANDERING CONTROL DEVICE FOR WEB

(71) Applicant: RISO KAGAKU CORPORATION, Tokyo (JP)

(72) Inventor: Hideaki Inoue, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/359,556

(22) Filed: Mar. 20, 2019

(65) Prior Publication Data

US 2019/0299677 A1 Oct. 3, 2019

(30) Foreign Application Priority Data

Mar. 30, 2018 (JP) ..... 2018-067121

(51) Int. Cl.

| | |
|---|---|
| ***B41J 15/04*** | (2006.01) |
| ***B41J 13/00*** | (2006.01) |
| ***B65H 23/038*** | (2006.01) |
| ***B41J 15/16*** | (2006.01) |

(52) U.S. Cl.

CPC ..... *B41J 15/046* (2013.01); *B41J 13/0009* (2013.01); *B65H 23/038* (2013.01); *B41J 15/16* (2013.01)

(58) Field of Classification Search

CPC ..... B41J 15/046; B41J 13/0009; B41J 15/16; B65H 23/038; B65H 23/0216; B65H 2557/10; B65H 2553/412

USPC ..... 347/104

See application file for complete search history.

(56) References Cited

U.S. PATENT DOCUMENTS 5,989,368 A * 11/1999 Tillander ..... B32B 38/1833 156/363

2012/0260813 A1* 10/2012 Neuber ..... B41F 13/025 101/481

FOREIGN PATENT DOCUMENTS

JP 2012-224468 A 11/2012

* cited by examiner

*Primary Examiner* — Huan H Tran

*Assistant Examiner* — Alexander D Shenderov

(74) *Attorney, Agent, or Firm* — Greenblum & Bernstein, P.L.C.

(57) ABSTRACT

A meandering control device includes: a detector configured to detect a position of an edge of a web being conveyed in a width direction of the web; a corrector configured to correct a position of the web being conveyed in the width direction; and a controller including a digital filter configured to perform filtering on a position signal indicating the position of the edge detected by the detector to attenuate a noise component. The controller is configured to drive the corrector to correct the position of the web in the width direction based on the position signal after the filtering.

6 Claims, 8 Drawing Sheets

MEANDERING CONTROL DEVICE FOR WEB

CROSS REFERENCE TO RELATED APPLICATION

This application is based upon and claims the benefit of priority from the prior Japanese Patent Application No. 2018-067121, filed on Mar. 30, 2018, the entire contents of which are incorporated herein by reference.

BACKGROUND

1. Technical Field

The disclosure relates to a meandering control device configured to correct meandering of a web.

2. Related Art

There is known an inkjet printing apparatus which performs printing on a print medium being a long web by ejecting inks from inkjet heads to the web while conveying the web.

When meandering of the web which is deviation of the position of the web in a width direction occurs in such an inkjet printing apparatus, ink landing position deviation occurs and print image quality decreases in some cases.

To counter this, Japanese Patent Application Publication No. 2012-224468 proposes a meandering control device which suppresses the meandering of a web in such a way that a roller on which the web is wound is turned to tilt with respect to a width direction of the web and thereby corrects the position of the web in the width direction.

The meandering control device suppresses the meandering of the web by controlling the angle of the roller such that an edge of the web returns to a normal position, based on a position signal outputted by an edge sensor configured to detect the position of the edge of the web.

The position signal outputted by the edge sensor sometimes includes a noise component due to an effect of disturbance. In order to reduce a decrease in accuracy of meandering correction caused by the effect of disturbance, the noise component is removed from the position signal by using a filter formed of passive elements such as a resistor, a capacitor, and an inductor.

SUMMARY

When a filter formed of passive elements as described above is used, the number of parts on an electric circuit increases. Moreover, it is time-consuming to select parts for setting the time constant of the filter suitable for the apparatus.

The disclosure is directed to a meandering control device which can reduce the number of parts on an electric circuit and time required for selection of parts.

A meandering control device in accordance with some embodiments includes: a detector configured to detect a position of an edge of a web being conveyed in a width direction of the web; a corrector configured to correct a position of the web being conveyed in the width direction; and a controller including a digital filter configured to perform filtering on a position signal indicating the position of the edge detected by the detector to attenuate a noise component. The controller is configured to drive the corrector to correct the position of the web in the width direction based on the position signal after the filtering.

According to the aforementioned configuration, it is possible to reduce the number of parts on an electric circuit and time required for selection of parts.

DETAILED DESCRIPTION

Figure 1:
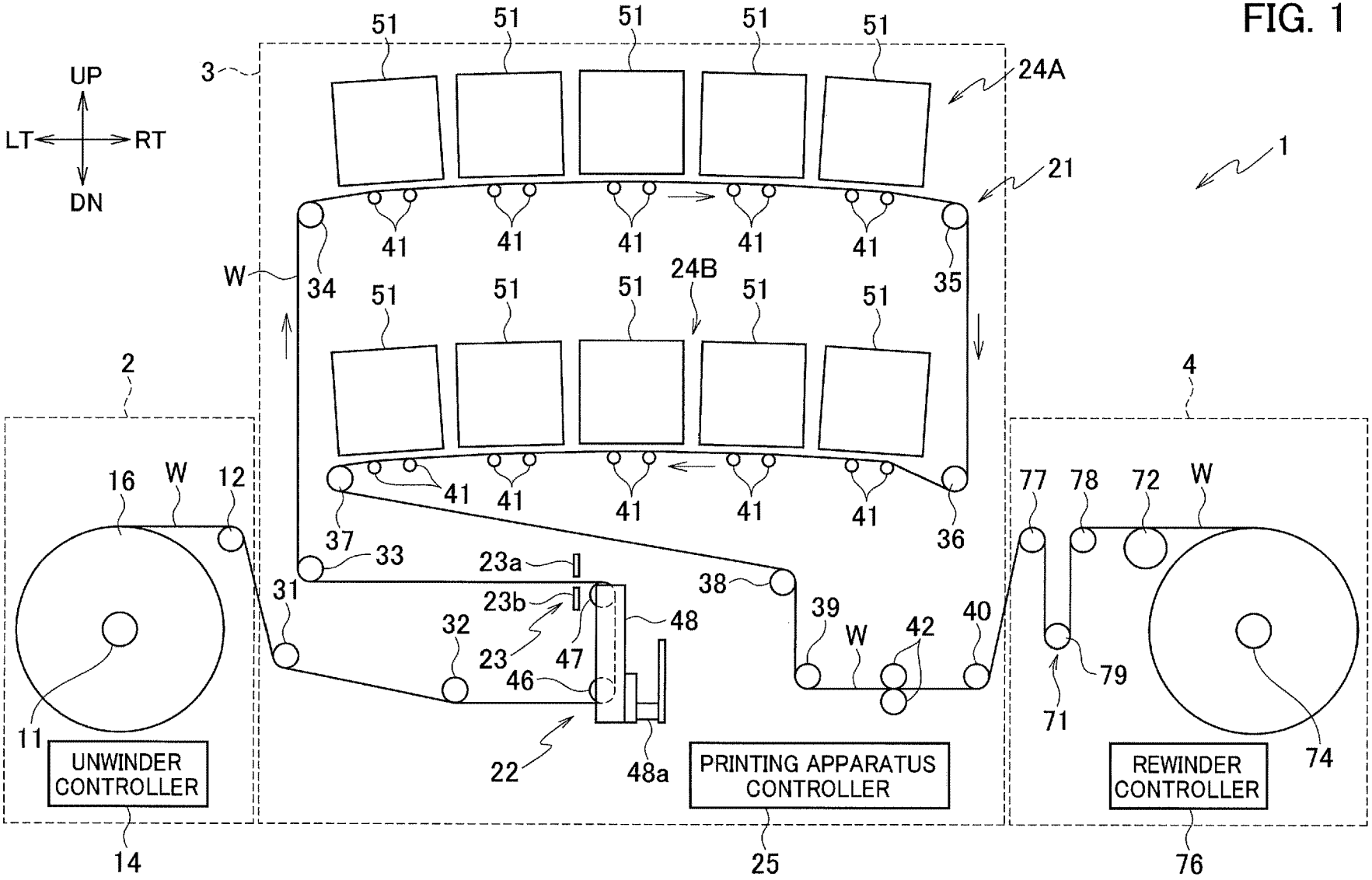
FIG. 1 is a schematic configuration view of a print system including an inkjet printing apparatus having a meandering control device according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
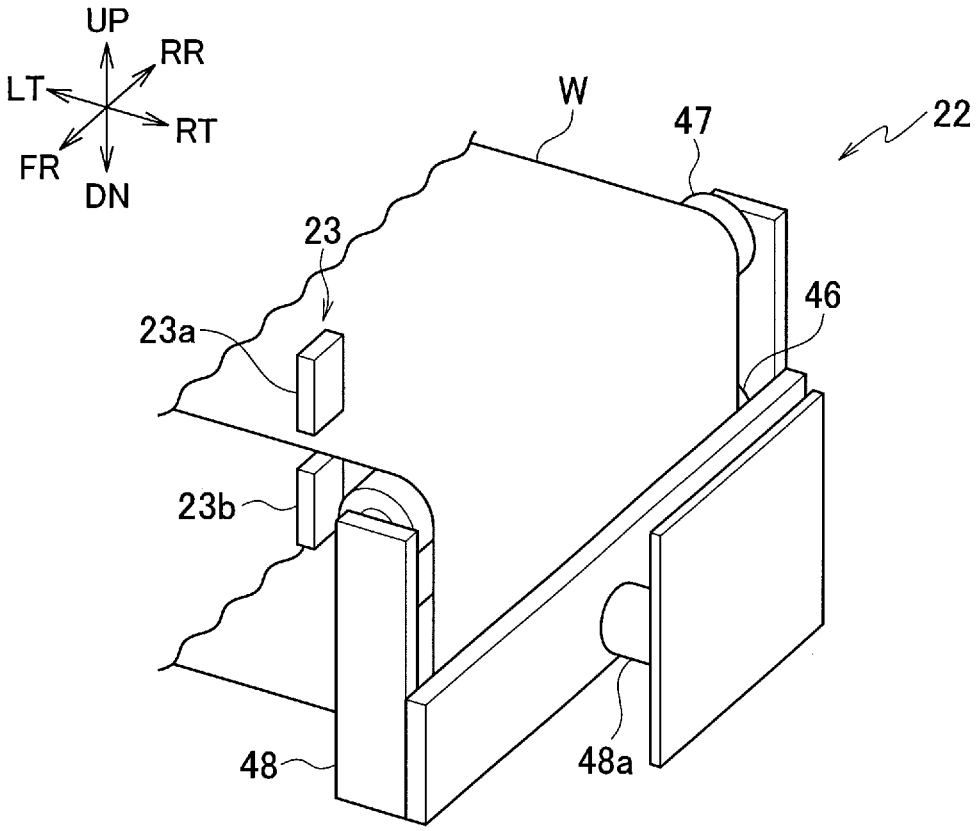
FIG. 2 is a perspective view illustrating a meandering corrector and an edge sensor of the inkjet printing apparatus.
Figure 3:
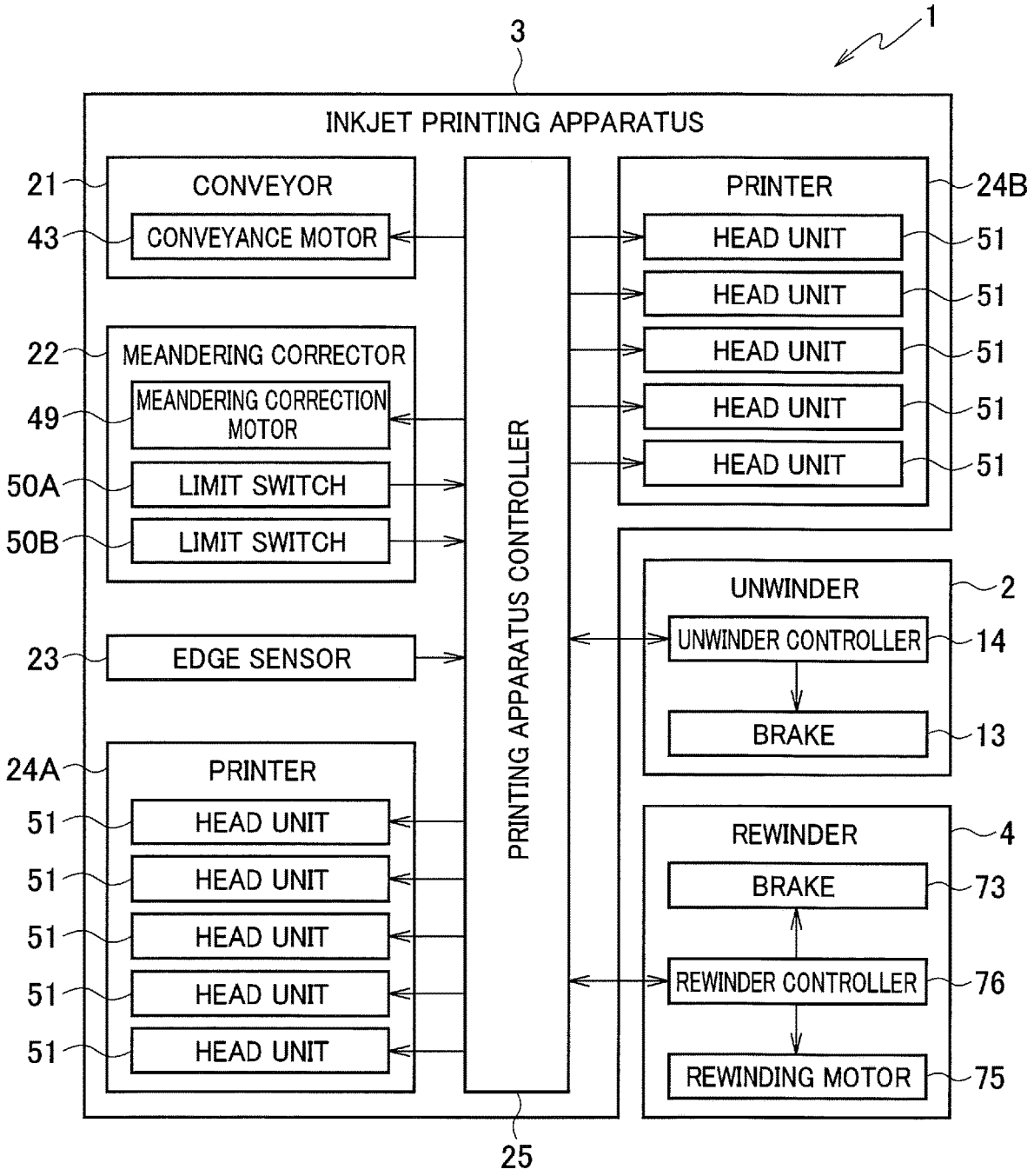
FIG. 3 is a control block diagram of a print system illustrated in FIG. 1.
Figure 4:
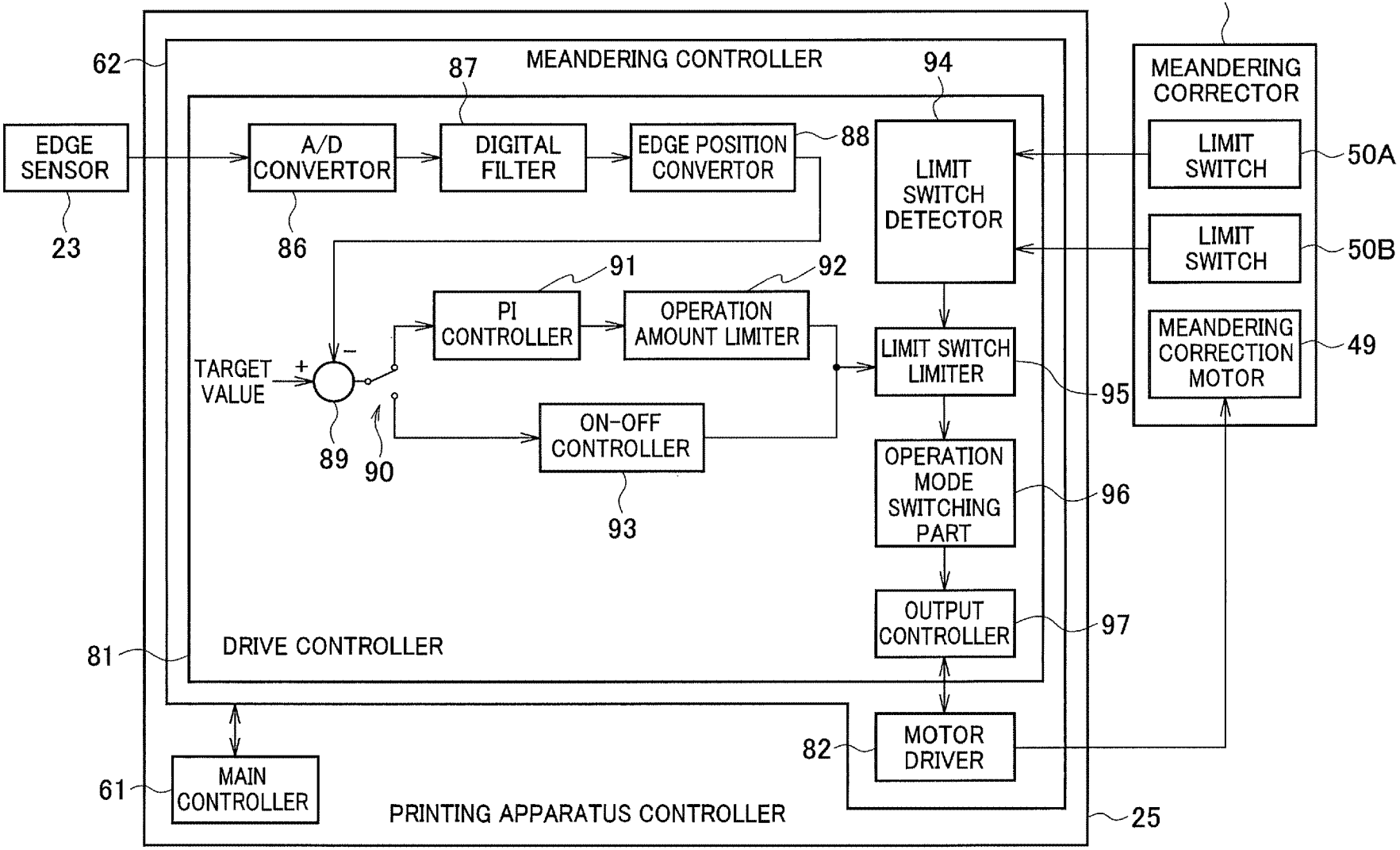
FIG. 4 is a block diagram illustrating a configuration of a printing apparatus controller in the inkjet printing apparatus.
Figure 5:
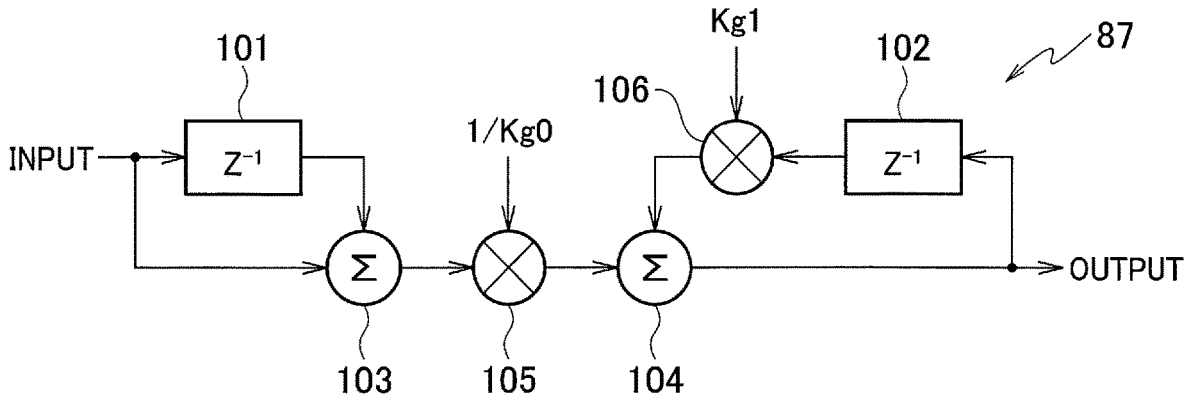
FIG. 5 is a block diagram of a digital filter included in a meandering controller of the printing apparatus controller.
Figure 9:
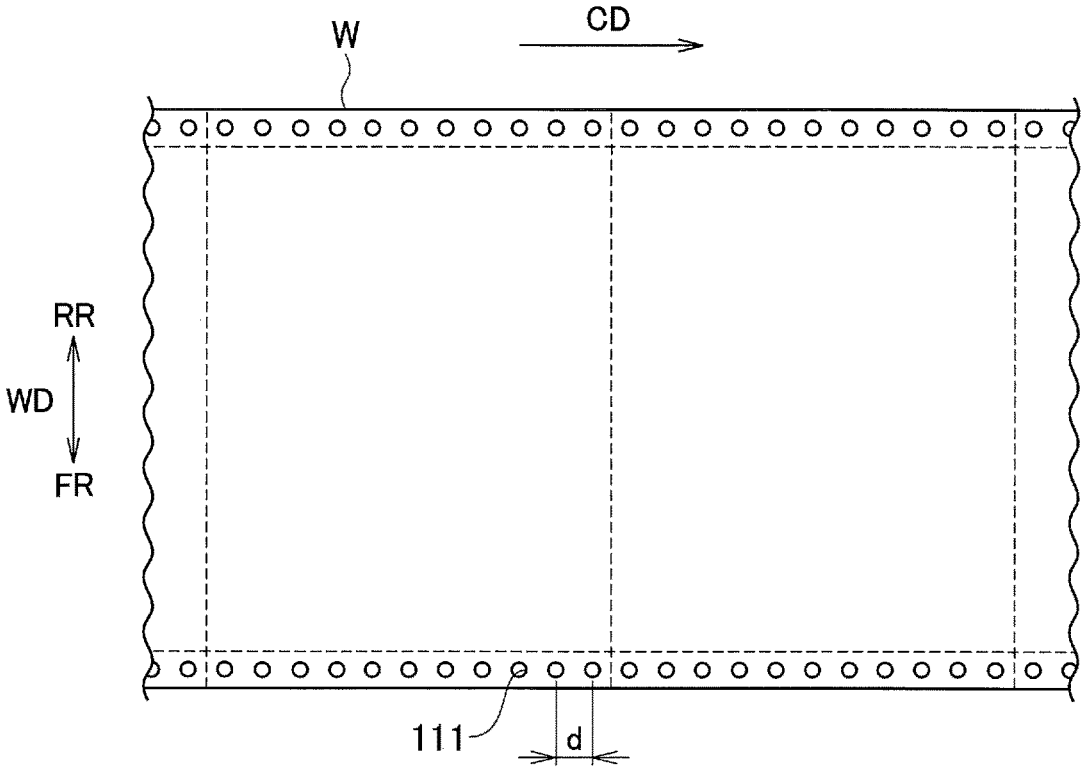
FIG. 9 is a view explaining a web with holes.

FIG. 1 is a schematic configuration view of a print system including an inkjet printing apparatus having a meandering control device according to a first embodiment of the present invention. FIG. 2 is a perspective view illustrating a meandering corrector and an edge sensor of the inkjet printing apparatus. FIG. 3 is a control block diagram of the print system illustrated in FIG. 1. FIG. 4 is a block diagram illustrating a configuration of a printing apparatus controller in the inkjet printing apparatus. FIG. 5 is a block diagram of a digital filter included in a meandering controller of the printing apparatus controller. In the following description, a direction orthogonal to the sheet surface of FIG. 1 is referred to as front-rear direction and a direction from the sheet surface toward the viewer is referred to as front. Moreover, up, down, left, and right in the sheet surface of FIG. 1 are referred to as directions of up, down, left, and right. In FIGS. 1, 2, and 9 (third embodiment), directions of right, left, up, down, front, rear, width direction, and conveyance direction are denoted by RT, LT, UP, DN, FR, RR, WD, and CD, respectively.

As illustrated in FIGS. 1 and 3, the print system 1 according to the first embodiment includes an unwinder 2, the inkjet printing apparatus 3, and a rewinder 4.

The unwinder 2 unwinds a web W being a long print medium made of film, paper, or the like to the inkjet printing apparatus 3. The unwinder 2 includes a web roll support shaft 11, a guide roller 12, a brake 13, and an unwinder controller 14.

The web roll support shaft 11 rotatably supports a web roll 16. The web roll support shaft 11 is formed in an elongated shape extending in the front-rear direction. The web roll 16 is the web W wound into a roll.

The guide roller 12 guides the web W between the web roll 16 and a guide roller 31 of the inkjet printing apparatus 3 to be described later. The guide roller 12 rotates by following the web W being conveyed.

The brake 13 applies brake to the web roll support shaft 11. Tension is thereby applied to the web W between the web roll 16 and a pair of conveyance rollers 42 of the inkjet printing apparatus 3 to be described later.

The unwinder controller 14 controls the brake 13. The unwinder controller 14 includes a CPU, a ROM, a RAM, a hard disk drive, and the like.

The inkjet printing apparatus 3 prints images on the web W while conveying the web W unwound from the unwinder 2. The inkjet printing apparatus 3 includes a conveyor 21, a meandering corrector 22, an edge sensor 23, printers 24A, 24B, and a printing apparatus controller 25. Note that the meandering corrector (corrector) 22, the edge sensor (detector) 23, and the printing apparatus controller (controller) 25 form a meandering control device.

The conveyor 21 unwinds and conveys the web W from the web roll 16. The conveyor 21 includes guide rollers 31 to 40, 20 under-head rollers 41, the pair of conveyance rollers 42, and a conveyance motor 43.

The guide rollers 31 to 40 guide the web W conveyed in the inkjet printing apparatus 3. The guide rollers 31 to 40 rotate by following the web W being conveyed. The guide rollers 31 to 40, the under-head rollers 41, the conveyance rollers 42, and meandering correction rollers 46, 47 of the meandering corrector 22 to be described later form a conveyance route of the web W in the inkjet printing apparatus 3.

The guide rollers 31, 32 guide the web W between the unwinder 2 and the meandering corrector 22. The guide roller 31 is arranged in a lower portion of a left end portion of the inkjet printing apparatus 3. The guide roller 32 is arranged between the guide roller 31 and the meandering correction roller 46 of the meandering corrector 22 to be described later.

The guide rollers 33 to 39 guide the web W between the meandering corrector 22 and the pair of conveyance rollers 42. The guide roller 33 is arranged on the left side of the meandering correction roller 47 of the meandering corrector 22 to be described later. The guide roller 34 is arranged above the guide roller 33. The guide roller 35 is arranged on the right side of the guide roller 34 at the same height as the guide roller 34. The guide roller 36 is arranged at a position below the guide roller 35 and above the guide roller 33. The guide roller 37 is arranged at a position which is on the left side of the guide roller 36 and which is near and on the right side of the web W between the guide rollers 33, 34 at substantially the same height as the guide roller 36. The guide roller 38 is arranged on the lower right side of the guide roller 37. The guide roller 39 is arranged below and slightly on the right side of the guide roller 38.

The guide roller 40 guides the web W between the pair of conveyance rollers 42 and the rewinder 4. The guide roller 40 is arranged in a lower portion of a right end portion of the inkjet printing apparatus 3.

The under-head rollers 41 support the web W under head units 51 to be described later in an area between the guide rollers 34, 35 and an area between the guide rollers 36, 37. The under-head rollers 41 rotate by following the web W being conveyed. Ten under-head rollers 41 are arranged in each of the area between the guide rollers 34, 35 and the area between the guide rollers 36, 37. Moreover, two under-head rollers 41 are arranged just under each head unit 51.

The pair of conveyance rollers 42 conveys the web W toward the rewinder 4 while nipping the web W. The pair of conveyance rollers 42 is arranged between the guide rollers 39, 40.

The conveyance motor 43 rotationally drives the conveyance rollers 42.

The meandering corrector 22 corrects meandering which is fluctuation in the position of the web W in a width direction (front-rear direction) by correcting the position of the web W in the width direction. The meandering corrector 22 is also able to correct meandering generated by skewing of the web W sent out from one or more rollers. The meandering corrector 22 is arranged upstream of the printer 24A in the conveyance direction of the web W on the conveyance route of the web W. Specifically, the meandering corrector 22 is arranged between the guide rollers 32, 33. As illustrated in FIGS. 1 to 3, the meandering corrector 22 includes the meandering correction rollers 46, 47, a meandering correction roller holder 48, a meandering correction motor 49, and limit switches 50A, 50B.

The meandering correction rollers 46, 47 are rollers for guiding the web W and correcting the meandering of the web W. The meandering correction rollers 46, 47 are each formed in a long columnar shape extending in the front-rear direction. The meandering correction rollers 46, 47 rotate by following the web W being conveyed. The meandering correction roller 46 is arranged on the right side of the guide roller 32. The meandering correction roller 47 is arranged above the meandering correction roller 46. The meandering correction rollers 46, 47 move the web W in the width direction by being turned to tilt with respect to the width direction (front-rear direction) of the web W as viewed in the left-right direction and thereby correct the meandering.

The meandering correction roller holder 48 holds the meandering correction rollers 46, 47. The meandering correction roller holder 48 is turnable about a turning axis 48*a* parallel to the left-right direction. The meandering correction rollers 46, 47 can be thereby turned to tilt with respect to the width direction (front-rear direction) of the web W as viewed in the left-right direction.

The meandering correction motor 49 turns the meandering correction roller holder 48 about the turning axis 48*a*.

The limit switches 50A, 50B are each a switch configured to detect that the turning angle of the meandering correction rollers 46, 47 relative to the horizontal has reached its upper limit. The limit switch 50A turns on when the rotation angle of the meandering correction rollers 46, 47 in one turning direction reaches the upper limit. The limit switch 50B turns on when the turning angle of the meandering correction rollers 46, 47 in the other turning direction reaches the upper limit.

The edge sensor 23 detects the position of an edge of the web W in the width direction and outputs a position signal indicating the detected position of the edge. The edge sensor 23 is arranged near and downstream of the meandering corrector 22 in the conveyance direction of the web W. The edge sensor 23 includes a light projector 23*a* and a light receiver 23*b*.

The light projector 23*a* and the light receiver 23*b* are arranged to face each other with a front end portion of the web W therebetween. The light projector 23*a* emits band-shaped parallel light toward the web W. The light projector 23*a* may include a light emitter. The light receiver 23*b* receives the parallel light emitted by the light projector 23*a*.

The width of a portion in which the parallel light emitted by the light projector 23*a* is blocked by the web W changes depending on the position of the front edge of the web W. Accordingly, the position of the edge of the web W is detected by using the width of the parallel light received by the light receiver 23*b*. The light receiver 23*b* outputs an analog signal depending on the width of the received parallel light as the position signal indicating the position of the edge of the web W.

Note that the edge sensor 23 may be arranged on the rear end side of the web to detect the position of a rear edge of the web W.

The printers 24A, 24B print images on a front side and a back side of the web W, respectively. The printer 24A is arranged near and above the web W between the guide rollers 34, 35. The printer 24B is arranged near and above the web W between the guide rollers 36, 37. The printers 24A, 24B each include five head units 51.

The head units 51 have inkjet heads (not illustrated) and print images by ejecting inks from nozzles of the inkjet heads to the web W. In each of the printers 24A, 24B, the five head units 51 eject inks of different colors, respectively.

The printing apparatus controller 25 controls operations of units in the inkjet printing apparatus 3. As illustrated in FIG. 4, the printing apparatus controller 25 includes a main controller 61 and a meandering controller 62.

The main controller 61 is responsible for control of the entire inkjet printing apparatus 3.

The meandering controller 62 includes a later-described digital filter 87 configured to perform filtering on the position signal detected by the edge sensor 23 and indicating the position of the web W to attenuate a noise component generated by disturbance, during the conveyance of the web W in the printing operation. The meandering controller 62 performs control such that the meandering corrector 22 corrects the position of the web W in the width direction based on the signal after the filtering by the digital filter 87. The configuration of the meandering controller 62 is described in detail later.

The rewinder 4 rewinds the web W subjected to printing in the inkjet printing apparatus 3. The rewinder 4 includes a buffer unit 71, a brake roller 72, a brake 73, a rewinding shaft 74, a rewinding motor 75, and a rewinder controller 76.

The buffer unit 71 maintains slack of the web W between the guider roller 40 of the inkjet printing apparatus 3 and the brake roller 72. The buffer unit 71 includes supporting rollers 77, 78 and a dancer roller 79.

The supporting rollers 77, 78 support the web W between the guide roller 40 and the brake roller 72. The supporting rollers 77, 78 are arranged away from each other in the left-right direction at the same height. The supporting rollers 77, 78 rotate by following the web W being conveyed.

The dancer roller 79 pushes down the web W with its own weight between the supporting rollers 77, 78. The buffer unit 71 thereby absorbs the slack of the web W between the guide roller 40 and the brake roller 72. The dancer roller 79 moves up and down depending on fluctuation in the slack amount of the web W between the guide roller 40 and the brake roller 72.

The brake roller 72 is a roller for applying brake to the web W rewound on the rewinding shaft 74. The brake roller 72 rotates by following the web W rewound on the rewinding shaft 74.

The brake 73 applies tension to the web W rewound on the rewinding shaft 74 by applying brake to the web W via the brake roller 72. This prevents formation of wrinkles and the like in the web W rewound on the rewinding shaft 74.

The rewinding shaft 74 rewinds and holds the web W.

The rewinding motor 75 rotates the rewinding shaft 74 clockwise in FIG. 1. Rotation of the rewinding shaft 74 causes the web W to be rewound on the rewinding shaft 74.

The rewinder controller 76 controls the brake 73 and the rewinding motor 75. The rewinder controller 76 includes a CPU, a ROM, a RAM, a hard disk drive, and the like.

Next, the configuration of the meandering controller 62 is described.

As illustrated in FIG. 4, the meandering controller 62 includes a drive controller 81 and a motor driver 82.

The drive controller 81 controls the motor driver 82. The drive controller 81 is formed of a micro-computer or the like including a CPU, a ROM, a RAM, and the like. The drive controller 81 includes an A/D convertor 86, the digital filter 87, an edge position convertor 88, a subtractor 89, a control switching part 90, a PI controller 91, an operation amount limiter 92, an on-off controller 93, a limit switch detector 94, a limit switch limiter 95, an operation mode switching part 96, and an output controller 97. The aforementioned parts of the drive controller 81 are implemented by causing the CPU to execute a program.

The A/D convertor 86 converts the position signal which is an analog signal received from the edge sensor 23 to a digital signal.

The digital filter 87 is a low-pass filter configured to perform filtering on the position signal converted to the digital signal to attenuate the noise component generated by disturbance. As illustrated in FIG. 5, the digital filter 87 includes delayers 101, 102, adders 103, 104, and multipliers 105, 106.

A digital value of the position signal is inputted into the digital filter 87 at a sampling cycle Ts in the AD conversion performed by the A/D convertor 86. The delayer 101 delays the input value by one cycle. The adder 103 adds the input value delayed by one cycle in the delayer 101 to the input value. The multiplier 105 multiplies the calculation result of the adder 103 by a reciprocal 1/Kg0 of a filter coefficient Kg0. The delayer 102 delays a calculation result of the adder 104 by one cycle. The multiplier 106 multiplies the calculation result of the adder 104 delayed by one cycle in the delayer 102 by a filter coefficient Kg1. The adder 104 adds the calculation result of the multiplier 106 to the calculation result of the multiplier 105 and outputs the result of the addition.

The following formula (1) is the aforementioned digital filter 87 expressed in a formula.

$$\text{output}=[(1+Z^{-1})]/[(Kg0\times(1+Kg1\times Z^{-1})]\times\text{input} \quad (1)$$

The filter coefficients Kg0, Kg1 in this formula are coefficients expressed by the following formulae (2) and (3), respectively.

$$Kg0=(2\times\tau/Ts)+1 \quad (2)$$

$$Kg1=[(2\times\tau/Ts)-1]/Kg0 \quad (3)$$

Note that τ is the time constant of the digital filter 87. A value set as a value at which the noise component included in the position signal can be removed is used as the time constant τ.

The edge position convertor 88 converts the value (digital value) of the signal after the filtering by the digital filter 87 to the value of the edge position of the web W.

The subtractor 89 subtracts the value of the edge position calculated by the edge position convertor 88 from a target value indicating a target position of the edge position to calculate an edge position error.

The control switching part 90 switches a control method of the meandering correction motor 49 between PI control and on-off control. In this example, the on-off control is a method of controlling the meandering correction motor 49 based only on the direction in which the edge of the web W deviates from the target position, regardless of the amount of the edge position error. Switching of the control method between the PI control and the on-off control is performed according to, for example, a command from the main controller 61 given in response to an instruction of a user.

The PI controller 91 performs PI calculation to calculate an operation amount of the meandering correction motor 49 for moving the position of the edge of the web W to the target position based on the edge position error. In this example, the operation amount is a value indicating the rotation speed and the rotation direction of the meandering correction motor 49.

When the operation amount calculated by the PI controller 91 is a value outside a preset range from a lower limit value to an upper limit value of the operation amount, the operation amount limiter 92 limits the operation amount such that the operation amount falls within this range.

The on-off controller 93 outputs an operation amount of the meandering correction motor 49 for returning the edge of the web W in the direction toward the target position based on the edge position error. This operation amount is a value set in advance depending on the direction of deviation of the web W from the target position.

The limit switch detector 94 detects turn-on of the limit switches 50A, 50B and outputs a signal of this detection to the limit switch limiter 95.

When any one of the limit switches 50A, 50B turns on, the limit switch limiter 95 limits the operation amount such that the rotation angle of the meandering correction rollers 46, 47 does not further increase from then on.

The operation mode switching part 96 switches an operation mode of the meandering control between an automatic mode and a manual mode. The automatic mode is a mode in which the meandering control of correcting the position of the web W in the width direction is performed automatically based on the position signal from the edge sensor 23. In the printing operation, the operation mode is generally set to the automatic mode. In the automatic mode, the operation mode switching part 96 outputs the operation amount from the limit switch limiter 95 to the output controller 97.

The manual mode is a mode in which the web W is moved to a specified position in the width direction according to a command from the main controller 61 given in response to an instruction of the user. In the manual mode, the operation mode switching part 96 outputs the operation amount for moving the web W which corresponds to the specified position to the output controller 97.

The output controller 97 converts the operation amount received from the operation mode switching part 96 to a duty ratio of a pulse width modulation (PWM) signal for controlling the drive of the meandering correction motor 49. Moreover, the output controller 97 determines the rotation direction of the meandering correction motor 49 based on the operation amount. Then, the output controller 97 outputs the PWM signal with the calculated duty ratio and a signal for controlling the rotation direction of the meandering correction motor 49 to the motor driver 82.

The motor driver 82 drives the meandering correction motor 49 based on the PWM signal and the signal for controlling the rotation direction of the meandering correction motor 49 received from the output controller 97.

Next, operations of the print system 1 are described.

In printing, when a print job is inputted, the main controller 61 of the printing apparatus controller 25 starts the drive of the conveyance motor 43, the unwinder controller 14 starts the drive of the brake 13, and the rewinder controller 76 starts the drive of the brake 73 and the rewinding motor 75. The conveyance rollers 42 thereby start to convey the web W while unwinding the web W from the web roll 16 by using tension and the rewinding shaft 74 starts the rewinding of the web W. Thus, the conveyance of the web W is started.

When the conveyance of the web W starts and then the conveyance speed of the web W reaches predetermined print conveyance speed Vg, the main controller 61 controls the conveyance motor 43 such that the print conveyance speed Vg is maintained.

After the start of constant speed conveyance of the web W at the print conveyance speed Vg, the main controller 61 controls the printers 24A, 24B based on the print job to cause them to print images on the web W.

Moreover, after the start of constant speed conveyance of the web W at the print conveyance speed Vg, the main controller instructs the meandering controller 62 to start the meandering correction control of the web W by the meandering corrector 22 before the printing by the printers 24A, 24B is started.

The meandering controller 62 starts the meandering correction control of the web W in response to the instruction of the main controller 61. In this example, it is assumed that, in the meandering controller 62, the control switching part 90 has selected the PI control. Moreover, the automatic mode is assumed to be set as the operation mode of the meandering control.

In the meandering correction control, the A/D convertor 86 of the meandering controller 62 converts the analog position signal received from the edge sensor 23 to the digital signal. The digital filter 87 performs filtering on the digitized position signal to attenuate the noise component generated by disturbance.

The edge position convertor 88 converts the digital value obtained after the filtering by the digital filter 87 to the value indicating the edge position of the web W. The subtractor 89 calculates the edge position error from the target value and the value indicating the edge position which is calculated by the edge position convertor 88.

The PI controller 91 performs the PI calculation to calculate the operation amount of the meandering correction motor 49 based on the edge position error calculated by the subtractor 89. The operation amount limiter 92 provides upper and lower limits to limit the operation amount calculated by the PI controller 91. The limit switch limiter 95 limits the operation amount when any one of the limit switches 50A, 50B turns on.

In this case, since the automatic mode is set as the operation mode of the meandering control, the operation mode switching part 96 outputs the operation amount received from the limit switch limiter 95 to the output controller 97.

The output controller 97 outputs the PWM signal with the duty ratio corresponding to the received operation amount and the signal for controlling the rotation direction of the meandering correction motor 49 to the motor driver 82. Then, the motor driver 82 drives the meandering correction motor 49 based on the PWM signal and the signal for controlling the rotation direction of the meandering correction motor 49 received from the output controller 97.

The meandering correction motor 49 thus turns the meandering correction rollers 46, 47 to reduce the deviation of the web W from the target position and the meandering of the web W is thereby reduced.

Figure 6:
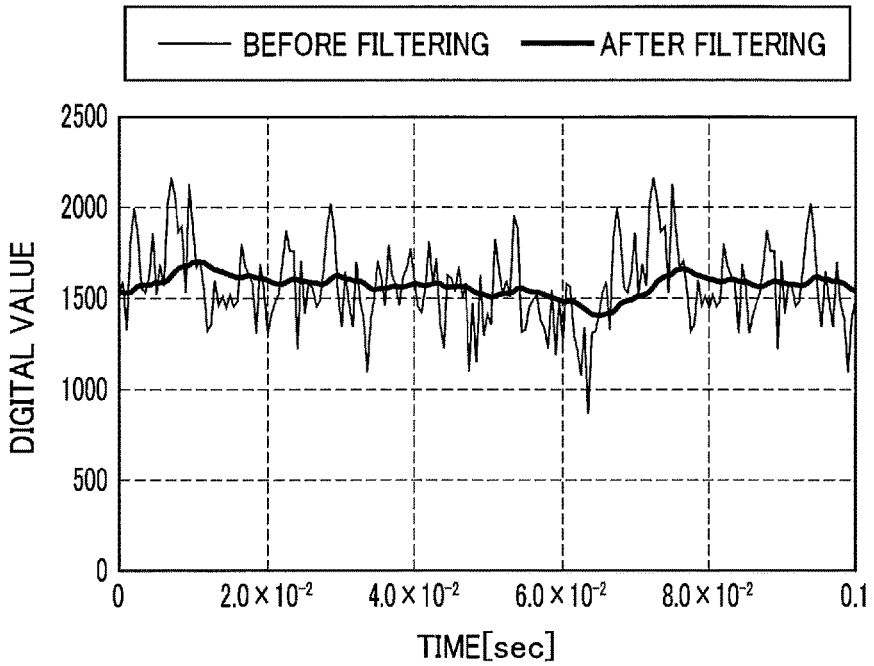
FIG. 6 is a view illustrating an example of signal waveforms before and after filtering by the digital filter in the first embodiment.

An example of signal waveforms before and after the filtering by the digital filter 87 is illustrated in FIG. 6. As illustrated in FIG. 6, since the noise component is removed by the filtering, a decrease in accuracy of the meandering correction caused by an effect of disturbance is reduced.

When the printing based on the print job is completed, the unwinder controller 14 stops the brake 13, the main controller 61 of the printing apparatus controller 25 stops the conveyance motor 43, and the rewinder controller 76 stops the brake 73 and the rewinding motor 75. The conveyance of the web W is thereby terminated and the series of operations is completed.

As described above, in the inkjet printing apparatus 3, the digital filter 87 performs the filtering on the position signal to attenuate the noise component. Accordingly, there is no need to form the filter by using passive elements such as a resistor and the number of parts on an electric circuit and time required to select the parts can be reduced.

Next, description is given of a second embodiment partially changed from the first embodiment.

In the second embodiment, the time constant $\tau$ of the digital filter 87 is set such that the digital filter 87 passes the meandering component of the web W corresponding to the rotation cycle of the web roll 16 while removing the noise component in the position signal.

The web roll 16 sometimes swings in the front-rear direction while rotating depending on the holding state by the web roll support shaft 11. In such a case, the meandering of the web W with a meandering cycle equal to the rotation cycle of the web roll 16 occurs.

In the inkjet printing apparatus 3, the web W is conveyed at the constant speed of the print conveyance speed Vg [m/s] in the printing operation as described above. Accordingly, the rotation cycle (meandering cycle) Tr [s] of the web roll 16 in the printing operation is expressed by the following formula (4).

$$tr=\varphi\times\pi/Vg \tag{4}$$

In this formula, $\varphi$ is a roll diameter [m] which is the outer diameter of the web roll 16.

Moreover, the time constant $\tau$ is expressed by the following formula (5).

$$\tau=-T/(\log e(1-Am/100)) \tag{5}$$

In this formula, Am is a signal amplitude percentage [%] and T is a signal cycle [s].

Assuming that T=Tr, the following formula (6) is obtained from formulae (4) and (5).

$$\tau=-(\varphi\times\pi/Vg)/(\log e(1-Am/100)) \tag{6}$$

The closer the signal amplitude percentage is to 100%, the smaller the degree of the attenuation of the signal is. Accordingly, it is possible to obtain a time constant $\tau$ which hardly attenuates the meandering component of the web W corresponding to the rotation cycle of the web roll 16 by setting a value which is almost 100% as the signal amplitude percentage Am in formula (6).

Note that, in the printing operation, the roll diameter $\varphi$ becomes smaller and the rotation cycle Tr becomes shorter as the printing proceeds. The state where the signal amplitude percentage Am is almost 100% can be maintained throughout a period in which the roll diameter $\varphi$ is reduced to the smallest diameter from the greatest roll diameter $\varphi$ by setting the time constant $\tau$ to a value at which the signal amplitude percentage Am is almost 100% when the roll diameter $\varphi$ is smallest. Here, the state where the roll diameter $\varphi$ is greatest is the state where the web roll 16 is fresh and the state where the roll diameter $\varphi$ is smallest is the state where the web W of the web roll 16 is completely used.

Accordingly, in the second embodiment, the time constant of the digital filter 87 is set to a time constant $\tau$ calculated from formula (6) with the signal amplitude percentage Am set to a predetermined signal amplitude percentage Amp which is almost 100% (for example, a value equal to or higher than 99.99%) and with the roll diameter $\varphi$ set to the smallest value. In this case, the smallest value of the roll diameter $\varphi$ corresponds to the outer diameter of a core (paper tube) of the web roll 16.

For example, assume that Vg=0.7 m/s, the smallest value of the roll diameter $\varphi$ is 0.12 m, and Am=Amp=99.99%. In this case, the time constant $\tau$ in the case where the roll diameter $\varphi$ takes the smallest value which is calculated from formula (6) is 0.058 s and this value is set for the digital filter 87.

Figure 7:
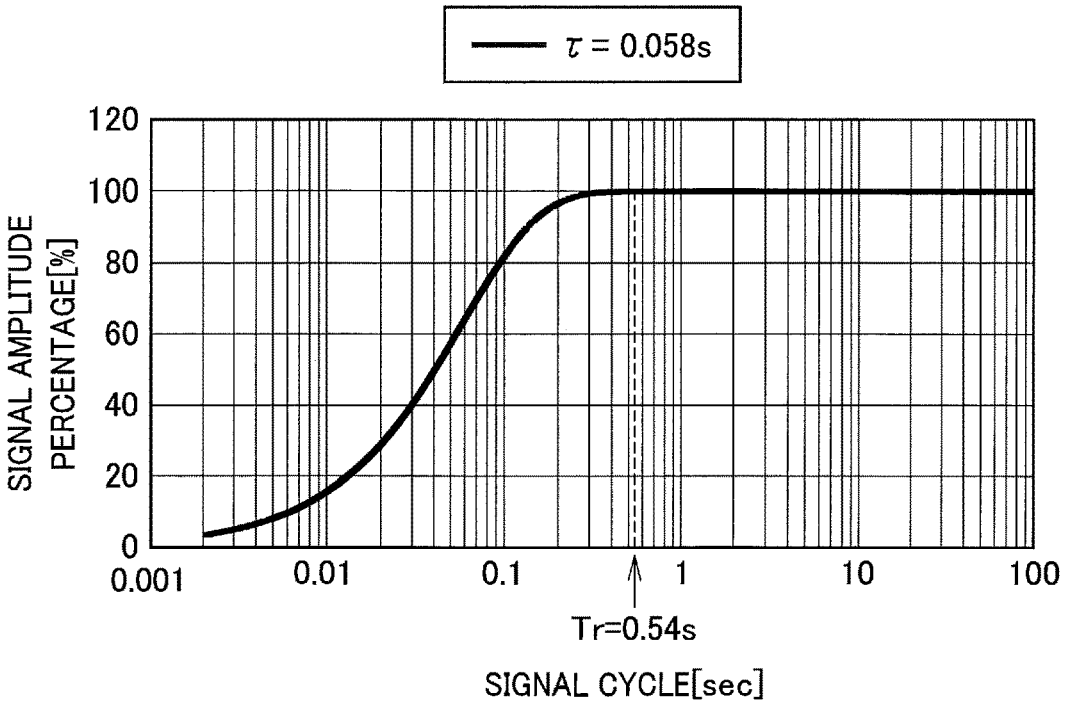
FIG. 7 is a view explaining an example of a time constant in a second embodiment.

A relationship between the signal cycle and the signal amplitude percentage Am in the case where time constant $\tau$=0.058 s is illustrated in FIG. 7.

When the roll diameter $\varphi$ is 0.12 m which is the smallest value, the rotation cycle Tr of the web roll 16 is 0.54 s according to formula (4). In this case, as illustrated in FIG. 7, the signal amplitude percentage Am of almost 100% (99.99%) is obtained at the rotation cycle Tr of 0.54 s which corresponds to the roll diameter $\varphi$ of 0.12 m.

Moreover, the signal amplitude percentage Am of almost 100% (99.99% or more) is obtained also when the rotation cycle Tr is greater than 0.54 s, that is when the roll diameter $\varphi$ is greater than 0.12 m which is the smallest value.

Accordingly, in this case, the digital filter 87 can pass the meandering component of the web W while removing the noise component in the position signal throughout a period until the entire web W in the fresh web roll 16 is completely used.

Figure 8:
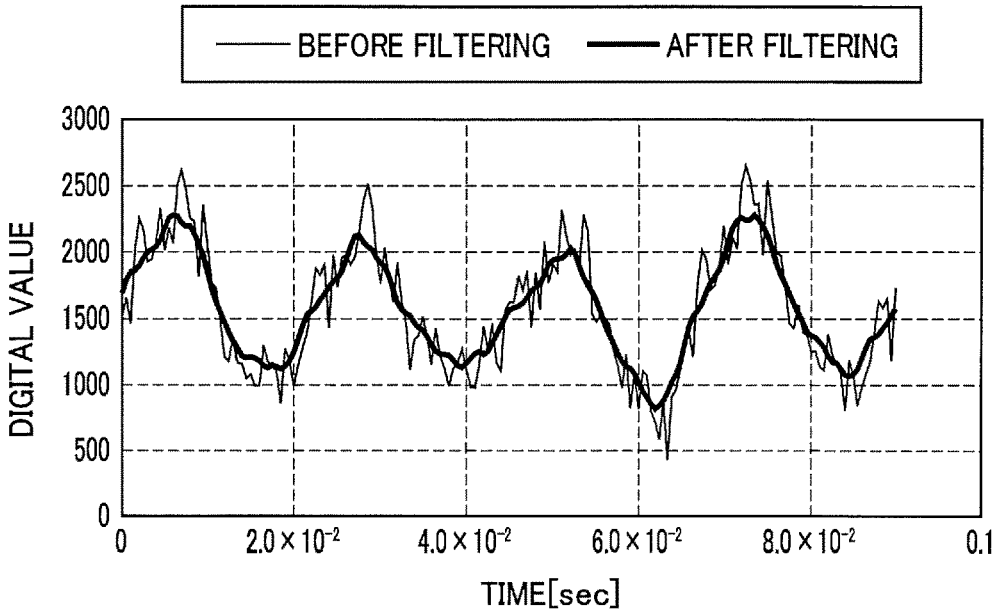
FIG. 8 is a view illustrating an example of signal waveforms before and after filtering by a digital filter in the second embodiment.

An example of signal waveforms before and after the filtering by the digital filter 87 in the second embodiment as described above is illustrated in FIG. 8. As illustrated in FIG. 8, the filtering by the digital filter 87 removes the noise component while leaving a large wave which is the meandering component of the web W corresponding to the rotation cycle of the web roll 16.

As described above, in the second embodiment, the printing apparatus controller 25 sets the time constant $\tau$ of the digital filter 87 such that the digital filter 87 passes the meandering component of the web W corresponding to the rotation cycle of the web roll 16 while removing the noise component in the position signal. This can improve extraction accuracy of the meandering component in the position signal. Accordingly, the decrease in the accuracy of the meandering correction of the web W can be reduced.

Note that the time constant τ of the digital filter 87 for passing the meandering component of the web W corresponding to the rotation cycle of the web roll 16 may be set to change depending on the change in the rotation cycle of the web roll 16 caused by the change in the roll diameter φ. In the digital filter 87, the time constant τ can be changed also during the printing operation by a program. Moreover, the roll diameter φ can be calculated based on the print conveyance speed Vg and the number of revolutions of the web roll 16 which can be detected by installing an encoder on the web roll support shaft 11 or by a similar method.

Next, description is given of a third embodiment partially changed from the first and second embodiments.

In the third embodiment, as illustrated in FIG. 9, a continuous sheet in which multiple holes 111 which are so-called sprocket holes are formed is used as the web W.

The holes 111 are formed to be aligned in the conveyance direction of the web W at a predetermined pitch d in one side end portion and the other side end portion of the web W in the width direction (front-rear direction).

When the web W with holes as illustrated in FIG. 9 is used, light of the light projector 23*a* in the edge sensor 23 passes through the holes 111 and a signal component corresponding to detection of the holes 111 is thereby included in the position signal outputted by the edge sensor 23 in some cases. The signal component corresponding to the holes 111 leads to a decrease in the accuracy of the meandering correction of the web W performed by the meandering corrector 22.

To counter this, in the third embodiment, the printing apparatus controller 25 sets the time constant τ of the digital filter 87 such that the digital filter 87 attenuates the signal component corresponding to the holes 111 of the web W.

A hole cycle Th being a cycle at which the holes 111 passes the position of the edge sensor 23 in the printing operation is expressed by the following formula (7).

$$Th=d/Vg \tag{7}$$

From formulae (5) and (7), the time constant τh for attenuating the signal component corresponding to the holes 111 is expressed by the following formula (8).

$$\tau h=-(d/Vg)/(\log e(1-Am/100)) \tag{8}$$

Moreover, from formula (8), the signal amplitude percentage Am of the signal component corresponding to the holes 111 is expressed by the following formula (9).

$$Am=(1-\exp(-d/(Vg\times\tau h)))\times 100 \tag{9}$$

In the third embodiment, a time constant τ at which the signal amplitude percentage Am calculated by using formula (9) takes a value equal to or less than an upper limit value Amq (for example 30%) is set as the time constant τ of the digital filter 87, the upper limit value Amq being a signal amplitude percentage Am at which the signal component corresponding to the holes 111 is considered to be sufficiently attenuated.

Moreover, the time constant τ set for the digital filter 87 as described above is set to a value at which the digital filter 87 passes the meandering component of the web W corresponding to the rotation cycle of the web roll 16 as in the second embodiment.

Specifically, the time constant τ obtained from formula (6) with the signal amplitude percentage Am set to the signal amplitude percentage Amp which is almost 100% (for example, a value equal to or higher than 99.99%) and with the roll diameter φ set to the smallest value is calculated as an upper limit value τ max of the time constant τ set for the digital filter 87. Then, the time constant τh which is equal to or less than the calculated upper limit value τ max of the time constant τ and at which the signal amplitude percentage Am calculated by using formula (9) is equal to or less than its upper limit value Amq is set as the time constant τ of the digital filter 87.

For example, assume that Vg=0.7 m/s, the smallest value of the roll diameter φ is 0.12 m, and Am=Amp=99.99%. Moreover, assume that the pitch d of the holes 111=0.0127 m and the upper limit value Amq of the signal amplitude percentage Am of the signal component corresponding to the holes 111=30%.

In this case, the time constant τ in the case where the roll diameter φ takes the smallest value which is calculated from formula (6) is 0.058 s and this value is set as the upper limit value τ max. When 0.058 s is plugged into τh=τ max and 0.0127 m is plugged into d in formula (9), Am is 26.7% and satisfies the condition that Am is equal to or less than the upper limit value Amq=30%. Accordingly, in this case, τh=0.058 s can be set as the time constant τ of the digital filter 87.

Also in this example, the signal amplitude percentage Am of almost 100% (99.99% or more) is obtained at a rotation cycle Tr equal to or more than 0.54 s which corresponds to the roll diameter φ of 0.12 m being the smallest value as in the example described in the second embodiment. Accordingly, the digital filter 87 can pass the meandering component of the web W throughout the period until the entire web W in the fresh web roll 16 is completely used.

Figure 10:
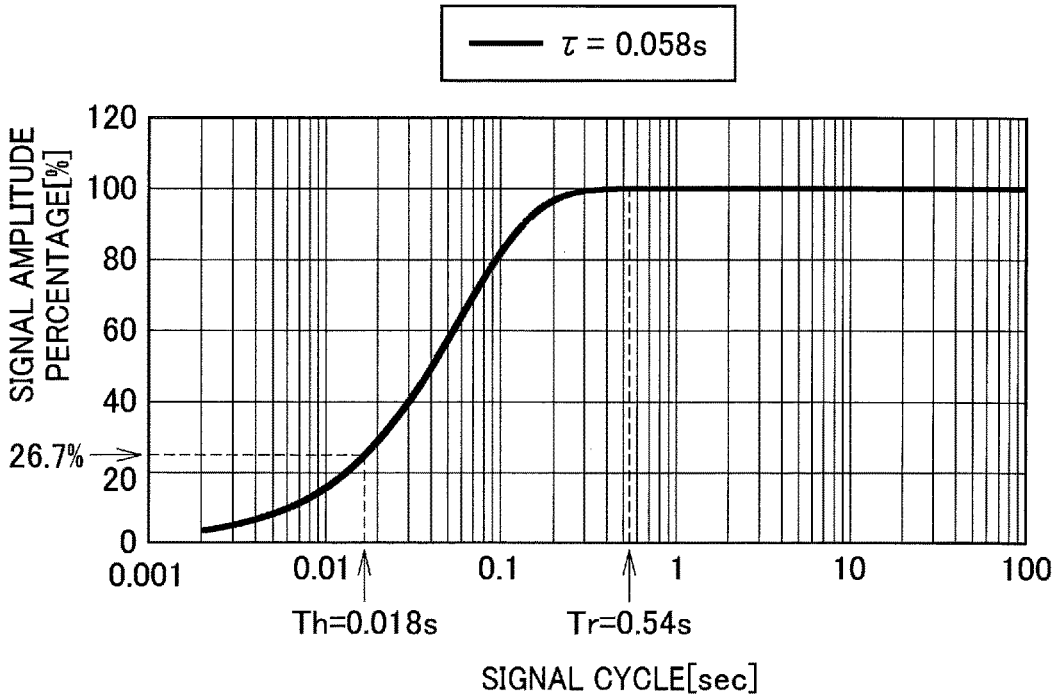
FIG. 10 is a view explaining an example of a time constant in a third embodiment.

Moreover, as illustrated in FIG. 10, the signal amplitude Am for the hole cycle Th of 0.018 s which corresponds to the pitch d of the holes 111 of 0.0127 m is 26.7% which is the value calculated from the aforementioned formula (9). In other words, in the case where the time constant τ=0.058 s, the signal component corresponding to the holes 111 can be attenuated to 26.7% of the original amplitude.

Figure 11:
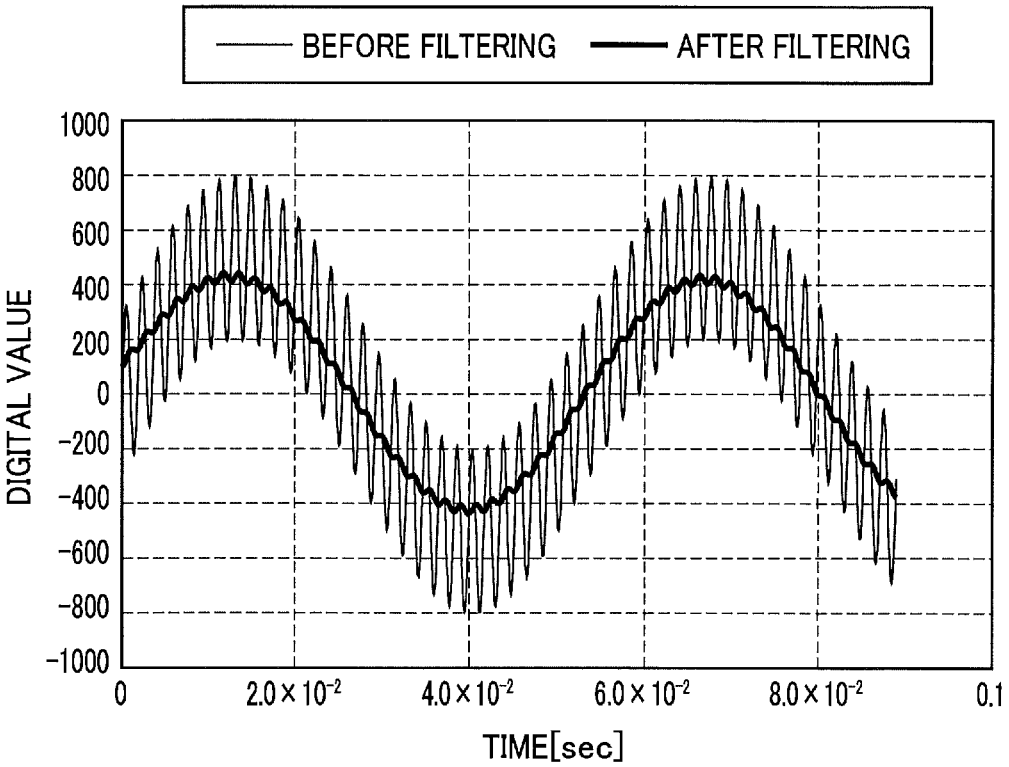
FIG. 11 is a view illustrating an example of signal waveforms before and after filtering by a digital filter in the third embodiment.

An example of waveforms before and after the filtering by the digital filter 87 in the third embodiment as described above is illustrated in FIG. 11. As illustrated in FIG. 11, the filtering by the digital filter 87 attenuates the signal component corresponding to the holes 111 which is a small wave while leaving a large wave which is the meandering component of the web W corresponding to the rotation cycle of the web roll 16.

As described above, in the third embodiment, the printing apparatus controller 25 sets the time constant τ of the digital filter 87 such that the digital filter 87 attenuates the signal component corresponding to the holes 111 of the web W. This can reduce the decrease in the extraction accuracy of the meandering component in the position signal also when the web W with holes is used for the printing. Accordingly, the decrease in the accuracy of the meandering correction of the web W can be reduced.

Note that the time constant τ of the digital filter 87 for passing the meandering component of the web W corresponding to the rotation cycle of the web roll 16 may be set to attenuate the signal component corresponding to the holes 111 of the web W without the upper limit value max of the timing constant τ being provided. Also in this case, it is possible to obtain the effect of reducing the decrease in the extraction accuracy of the meandering component in the position signal by attenuating the signal component corresponding to the holes 111.

Although the edge sensor is the optical sensor including the light projector and the light receiver in the first to third embodiments, the edge sensor may be a different type of sensor such as an ultrasonic sensor.

Moreover, although the configuration in which the unwinder and the rewinder are connected to the inkjet printing apparatus as separate apparatuses is described in the first to third embodiments, the configuration may be such that the unwinder and the rewinder are incorporated in the inkjet printing apparatus.

The embodiments of the disclosure have, for example, the following configurations.

A meandering control device includes: a detector configured to detect a position of an edge of a web being conveyed in a width direction of the web; a corrector configured to correct a position of the web being conveyed in the width direction; and a controller including a digital filter configured to perform filtering on a position signal indicating the position of the edge detected by the detector to attenuate a noise component. The controller is configured to drive the corrector to correct the position of the web in the width direction based on the position signal after the filtering.

The web may be unwound and conveyed from a web roll. The controller may be configured to set a time constant of the digital filter such that the digital filter passes a meandering component of the web in the position signal corresponding to a rotation cycle of the web roll.

The web may have holes aligned in a conveyance direction of the web. The controller may be configured to set a time constant of the digital filter such that the digital filter attenuates a signal component in the position signal corresponding to the holes.

The corrector may include a roller configured to rotate by following the web being conveyed.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A meandering control device comprising:

a detector configured to detect a position of an edge of a web being conveyed in a width direction of the web;

a corrector configured to correct a position of the web being conveyed in the width direction; and a controller including a digital filter configured to perform filtering on a position signal indicating the position of the edge detected by the detector to attenuate a noise component of the position signal generated by a disturbance of the web, the controller configured to drive the corrector to correct the position of the web in the width direction based on the position signal after the filtering, wherein a value of a time constant of the digital filter is a value at which the noise component included in the position signal is removed by the digital filter, and wherein the web is unwound and conveyed from a web roll, and the controller is also configured to set the time constant of the digital filter to depend on the outer diameter of the web roll.

2. The meandering control device according to claim 1, wherein the corrector comprises a roller configured to rotate by following the web being conveyed.

3. A meandering control device comprising:

a detector configured to detect a position of an edge of a web being conveyed in a width direction of the web;

a corrector configured to correct a position of the web being conveyed in the width direction; and a controller including a digital filter configured to perform filtering on a position signal indicating the position of the edge detected by the detector to attenuate a noise component, the controller configured to drive the corrector to correct the position of the web in the width direction based on the position signal after the filtering, wherein the web is unwound and conveyed from a web roll, and the controller is configured to set a time constant of the digital filter such that the digital filter passes a meandering component of the web in the position signal corresponding to a rotation cycle of the web roll.

4. The meandering control device according to claim 3, wherein the web has holes aligned in a conveyance direction of the web, and the controller is configured to set the time constant of the digital filter such that the digital filter attenuates a signal component in the position signal corresponding to the holes.

5. The meandering control device according to claim 3, wherein the corrector comprises a roller configured to rotate by following the web being conveyed.

6. A meandering control device comprising:

a detector configured to detect a position of an edge of a web being conveyed in a width direction of the web;

a corrector configured to correct a position of the web being conveyed in the width direction; and a controller including a digital filter configured to perform filtering on a position signal indicating the position of the edge detected by the detector to attenuate a noise component, the controller configured to drive the corrector to correct the position of the web in the width direction based on the position signal after the filtering, wherein the web has holes aligned in a conveyance direction of the web, and the controller is configured to set a time constant of the digital filter such that the digital filter attenuates a signal component in the position signal corresponding to the holes.

* * * * *